United States Patent [19]

Harris

[11] 4,118,611

[45] Oct. 3, 1978

[54] BUCKLING SPRING TORSIONAL SNAP ACTUATOR

[75] Inventor: Richard Hunter Harris, Raleigh, N.C.

[73] Assignee: International Business Machines Corporation, Armonk, N.Y.

[21] Appl. No.: 829,039

[22] Filed: Aug. 30, 1977

[51] Int. Cl.[2] ..... H01H 13/28

[52] U.S. Cl. ..... 200/67 A

[58] Field of Search ..... 200/67 R, 67 A

[56] References Cited

U.S. PATENT DOCUMENTS

| | | | |
|---|---|---|---|
| 2,810,031 | 10/1957 | Hellstrom | 200/67 R |
| 3,491,218 | 1/1970 | Robbins | 200/67 A X |
| 3,699,296 | 10/1972 | Harris | 200/67 DB |
| 3,731,030 | 5/1973 | Holzer | 200/159 R |
| 3,842,229 | 10/1974 | Boulanger | 200/159 R |
| 3,863,040 | 1/1975 | Van Benschotea | 200/67 DB |
| 3,899,648 | 8/1975 | Murata | 200/67 DB |

*Primary Examiner*—Donald F. Norton
*Attorney, Agent, or Firm*—Edward H. Duffield

[57] ABSTRACT

A torsional or rocker switch actuator is described that uses the torsional moment of a buckling compression spring column to rock the actuator member on a pivot. A catastrophically buckling compression column spring is used and the reaction moment which occurs as the spring buckles is applied to rock an actuator back and forth between open and closed positions with cooperating contacts beneath the actuator. A non-teasible, snap action, tactile feedback, key mechanism of extreme mechanical simplicity and high reliability is achieved.

4 Claims, 5 Drawing Figures

BUCKLING SPRING TORSIONAL SNAP ACTUATOR

FIELD OF THE INVENTION

The invention relates to snap action switches and switch actuators in general and in particular to rocker type switch or toggle switches having snap action of a pivotal member.

PRIOR ART

A great number of rocker type snap action switches exist in the prior art. Some prior art designs utilize a compression column spring in conjunction with the rocker actuator. However, as will appear below, the prior designs have generally required more mechanical elements to achieve the desired operation of the snap action rocker mechanism and have resorted to pushers or biasing members to create the desired direction of motion in the actuated position and to achieve a return to the unactuated position.

U.S. Pat. No. 2,810,031 illustrates a snap action rocker type of switch in which a coil spring is used to drive a pivoted rocker actuator back and forth. However, an additional member must be added between the push button and the rocker element to assure the appropriate direction of travel upon initiation of action and to provide a restoring action upon release. An additional member is used to create the proper torsional moment direction to rock the rocker in the desired manner. This additional element may be a source of instability and an eventual source of failure should sticking or wear interfere with the desired operation.

Another similar patent is U.S. Pat. No. 3,863,040 in which a compression column spring buckles about its longitudinal axis to contact contactor members at either side. My own previous U.S. Pat. No. 3,699,296 is of the same generic sort and in neither patent is the buckling compression column switch utilized to produce torsional moments on an actuator. Instead, the spring itself is the contacting member.

A snap action rocker switch is shown in U.S. Pat. No. 3,491,218, but an additional actuating member is positioned between the key button and the rocker in order to insure the proper direction of rotation in the rocker element.

It is apparent that in the prior art of compression column rocker type switches that additional rocker rotation mechanisms have been employed to generate the desired initial rocking direction for the rocker. These additional mechanisms are a source of expense in constructing the key switches and may be a possible source of failure due to wear or sticking problems. The assembling of such devices is also more complicated than would be desired.

OBJECTS OF THE INVENTION

To overcome the foregoing shortcomings noted with the prior art, it is an object of the present invention to provide an improved snap action rocker switch utilizing a buckling compression column and specifically the reaction moment of the buckling column to rock the rocker element over center and to restore it to its initial position on release of the buckled column spring.

It is a further object of the present invention to provide an improved snap action rocker switch which utilizes only a single spring element and does not require mechanical interposes, pushers or other separate rocking direction initiation or restoration structures.

SUMMARY OF THE INVENTION

The foregoing and yet other objects not enumerated for the present invention are achieved in the invention by utilizing the reaction moment at the ends of a compression column buckling switch member such as that shown in my own previous U.S. Pat. No. 3,699,296. Additional structure is created for the device which includes a means for insuring the direction of buckle for the catastrophically buckling compression spring and the addition of a rocker element to act as the electrical connector or make/break element. The rocker is self-restoring to the unactuated position once pressure on the key top is released since the compression column spring will relax and exert a moment in the opposite direction to that which it exerted when it was buckled.

BRIEF DESCRIPTION OF THE DRAWINGS

The invention will now be more specifically described with reference in particular to a preferred embodiment thereof generally illustrates in the drawings as follows.

DETAILED SPECIFICATION

Figure 1A:
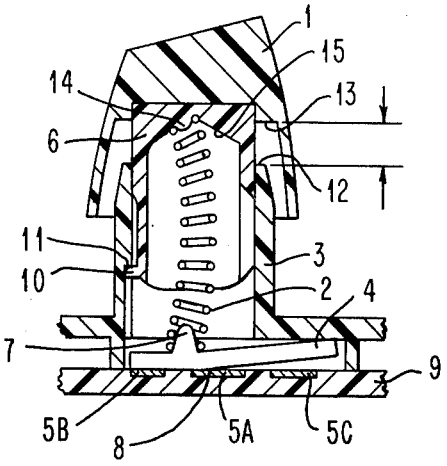
FIG. 1A illustrates a preferred embodiment of the invention in a cross-sectional view taken parallel to the longitudinal axis of the compression spring.

In describing the preferred embodiment of the invention, reference will now be had to FIG. 1A of the drawings where a vertical section taken through a representative key actuator according to the present invention is shown. In FIG. 1A the key top or key button 1 is shown in its undeflected position before the application of a force to the top of the key button illustrated by the arrow labeled F in FIG. 1B. The catastrophically buckling compression column spring element 2 is shown as a helical compression spring member. My own prior U.S. Pat. No. 3,699,296 will be incorporated here by reference in its entirety to serve as a teaching of the characteristics that compression column springs of the catastrophic buckling type require. It will be understood by those of skill in the art that other configurations for the compression column springs such as thin wires, rods or flat leaves may be used.

A housing 3 is provided as shown to contain the stem or barrel 6 of the key top 1. It will be appreciated that the key member 1 and the housing 3 are preferably formed of plastic, injection molded to the shape desired, or of some other similar inexpensive non-conductive material. In the preferred embodiment, injection molded plastic parts are utilized for the key top 1, the housing 3 and for the rocking actuator or coupling member 4.

As can be seen in FIG. 1A, the coupling member 4 is provided with a mounting point 7 over which the helical compression column spring 2 fits. The rocking coupling member 4 is formed of injection molded conductive plastic for example, in the preferred embodiment, and has a general V or rocker shape with a pivot point located generally in line with the edge of the compression column spring 2 as illustrated by point 8 in FIG. 1A. Individual electrical contacts 5A, 5B, and 5C are shown mounted on a circuit board or other similar non-conductive substrate 9. The connections to the contacts 5A through 5C which would be made to utilize the electrical characterstics achieved by rocking member 4 back and forth between contacts 5A, 5B, and 5C are not shown, since these would be obvious to those of skill in the art. The contacts 5A through 5C in the preferred embodiment constitute plates in a capacitive switching system and it will be understood that the contacts will be covered by a thin layer of dielectric material to create a capacitive action when actuator 4 is in close proximity to any two of the plates 5A through 5C. As illustrated in FIG. 1A, a capacitive coupling exists between plates 5A and 5B through the medium of actuator 4. Plates 5A and 5C with rocker 4 positioned as illustrated in FIG. 1A are not as capacitively coupled together as contacts 5A and 5B. Thus, contacts 5A and 5C would be called the normally open contact set. This condition could be indicative of either an "ON" or an "OFF" condition and the electrical logic of the using system, not shown, could be configured to make advantage of either the normally open or normally closed condition as indicative of actuation.

Figure 1B:
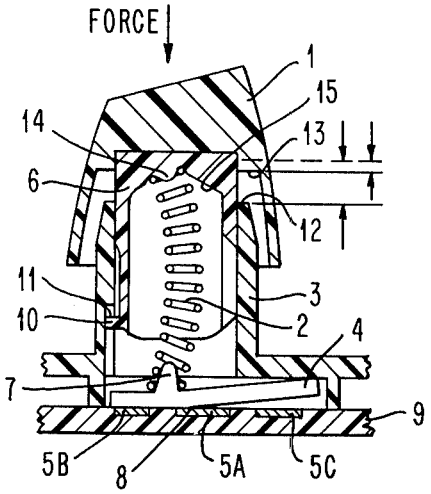
FIG. 1B illustrates the mechanism in FIG. 1A with the key top partially depressed.

FIG. 1B illustrates the mechanism as shown in FIG. 1A but with a force F applied to the key top 1 to depress it from its uppermost position shown in FIG. 1A. The upward extent of travel is limited by the projection 10 interfering with ledge 11 in the housing 3. Projection 10 is made a portion of the barrel 6 (or stem) of key top 1. The downward limit of travel is created by interference between the under surface of key top 1 identified by numeral 13 and the upper surface of the housing 3 identified by numeral 12.

In FIG. 1B, the mechanism has had an increased force F applied to key top 1 as mentioned previously. This has resulted in a slight depression of the key top and compression of the catastrophically buckling compression column spring member 2. This action produces a slight lateral deflection in spring element 2 and creates a rotational moment at both ends of spring 2 as a reaction to the lateral deflection. It will be noted that the upper end of compression column spring 2 is mounted in a mounting base 14 in barrel 6 which is angled slightly to set the initial direction of deflection for spring 2 to the right as illustrated in the figures. This assures the initial direction of deflection and of eventual buckling compression column spring 2.

Figure 1C:
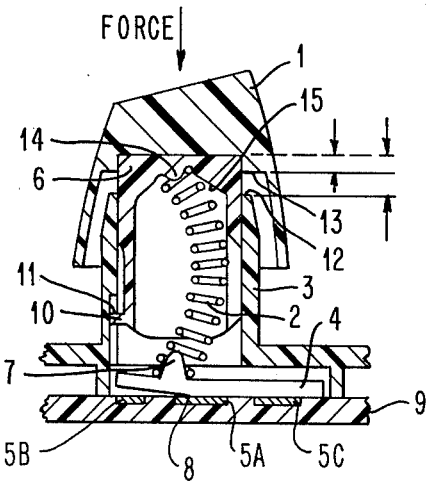
FIG. 1C illustrates the mechanism in FIGS. 1A and 1B with the key top further depressed to the point at which catastrophic buckling in the spring member occurs.

FIG. 1C illustrates the mechanism as shown in FIGS. 1A and 1B but with key top 1 depressed still further to a point at which catastrophic buckling of spring member 2 has just occurred. In this condition, it will be noted that the end of the compression column spring 2 which was mounted in mount 14 in barrel 6 has pivoted free about one edge of the coil spring itself and, as will be understood by those of skill in the art and as taught in my own prior U.S. Pat. No. 3,699,286, this action occurs in a rapid and catastrophic manner to produce a sudden snap action. The rotational moment applied to the rocker member 4 rocks it over center to the right as shown in FIG. 1C so that capacitive coupling exists between contacts 5A and 5C through the medium of the right leg of actuator 4. Capacitive contacts 5A and 5B are no longer coupled as shown. The sudden snap action provides a tactile feedback to a human operator due to the sudden decrease in force as will be described more specifically later, and also produces an audible feedback since the sudden pivoting of the rocker member 4 produces a clicking noise.

Figure 1D:
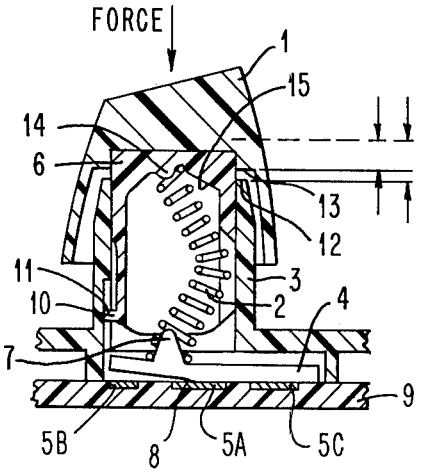
FIG. 1D illustrates the mechanism as shown in FIGS. 1A through 1C with the key top further depressed after catastrophic buckling of the spring member has occurred.

FIG. 1D illustrates the mechanism as shown in FIGS. 1A through 1C, but with key top 1 further depressed toward its utmost depression which would create contact between surfaces 13 and 12 as noted previously. No further rotation or motion occurs in this condition up to the limiting point of travel in the downward direction for key top 1. Upon release of pressure, the compression column spring 2 will relax and return in the direction from which it came.

Figure 2:
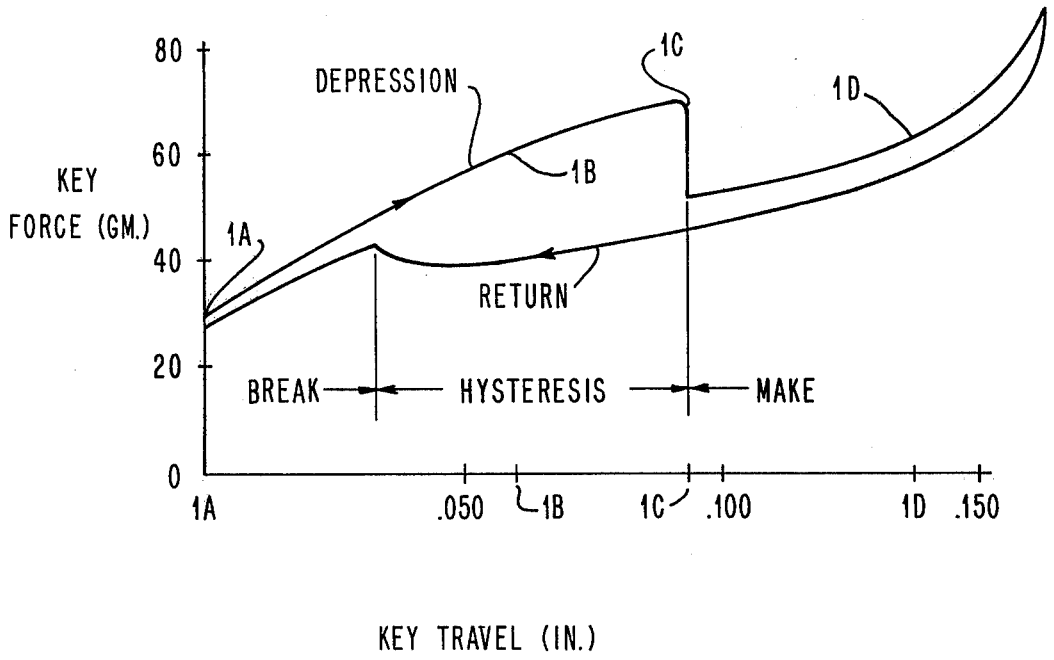
FIG. 2 illustrates the key force and displacement characteristic of the present rocking switch actuator constructed as illustrated in FIGS. 1A through 1D.

Turning to FIG. 2, a typical key force and displacement profile for the mechanism of the invention as illustrated in FIGS. 1A through 1D is shown. The key force is that force F required to depress the key top 1 and is shown on the vertical axis in the force and travel diagram. A typical key travel in inches is shown and is meant to represent the amount of vertical deflection that key top 1 experiences due to increase in force F. It will be noted in FIG. 2 that the position approximated by the mechanism shown in FIG. 1A is identified on the key force profile by a small 1A designation. The same is true for each of the other figures 1B through 1D which have their various relative positions on the key force and deflection diagram indicated as shown. It will be observed that a fair amount of physical hysteresis, which is of importance in creating non-teasibility, exists in the structure since the mechanism does not snap back over center until a point below that at which snap over occurred is reached.

STATEMENT OF OPERATION

It will be appreciated with regard to the figures that depression of the key button 1 moves the key button and its stem 6 into the housing 3, creating longitudinal compression and lateral deflection of the helical compression spring 2. An initial counter-clockwise moment is exerted on the rocker member 4 which is approximately equal to the force F times the distance between the pivot point 8 of the rocking member 4 and the center line of the spring. The upper end of the helical spring 2 is held squarely against the key button 1 by a clockwise moment created by a force equal to approximately F times the diameter of the spring divided by two. The rocker member 4 will initially be held firmly over the contacts 5A and 5B. As the lateral motion of the center of the helical compression spring 2 increases, both the top and bottom reaction moments in spring 2 are decreased because F is transmitted through the center section of spring 2. Shortly after these moments approach 0, the rocker member rocks to a position squarely over contacts 5A and 5C and the top of spring 2 rocks about the right hand edge of its topmost coil. The constraints upon the depression column spring have changed from an initial end clamped condition to an end clamped-pinned condition. This sudden change provides the tactile response of the key and is accompanied by a sudden rocking action of the rocker member 4 which creates an acoustic feedback as well.

Upon release of pressure, rocker member 4 will be rapidly snapped in the counter clockwise direction at a position in the key travel that is less than that required initially to cause a clockwise snapping action discussed previously. This effect is due to the catastrophic buckling point, in this case the unbuckling or restoration point, is reached at a key travel position measured from the undepressed condition that is less than that which created buckling in the first place. The reason for this is that the end clamped-pinned condition that exists after buckling has occurred in the downward stroke of the key button, the end conditions change as noted above and the degree of key travel required will be less than that for the initial end clamped condition at which the catastrophic buckling spring member initially resides. A second cause for the difference between the unbuckling point in the key travel and the buckling point is that the snapping of the rocker member 4 creates an instantaneous increase in the lateral deflection of the center of the helical compression spring 2. This requires that the key travel must be less in order to cause the same lateral deflection that initially caused the clockwise snap.

A differential capacitance circuit is used in the preferred embodiment illustrated to detect actuation of the key switch. Either a normally open or normally closed capacitive scheme would work as well and it should be clearly understood that normal electrical contacts for normally open normally closed conduction between contacts 5A, 5B, and 5C could be used equally well. A variety of other electrical signal producing means might be employed, such as inductive, piezo electric or light interruption sensors could be employed instead of the electrical contacts 5A, 5B, and 5C. The overall structure would remain the same as will be appreciated by those of skill in the art.

Having thus described my invention with particular relationship to a preferred embodiment thereof, what is desired to be protected by Letters Patent and which is claimed is:

1. In an electrical key actuating mechanism having a key top, a housing having means for slidably receiving said key top for vertical motion thereof, a pivoting rocker type electrical actuating means in said housing opposite said key top, electrical means for actuation by said electrical actuating means, and also having a buckling compression spring means under precompression and mounted between said key top and said pivoting rocker type electrical actuating means, the improvements comprising:

lateral deflection offset spring mounting means within said housing bearing against said buckling compression spring and displacing the central portion thereof relative to its ends in a first chosen direction for promoting buckling of said buckling compression spring in said first chosen direction;

mounting means on said key top for pivotally mounting the proximal end of said buckling compression spring; and mounting means on said rocker for mounting the distal end of said buckling compression spring with an edge of said spring colinear with said pivot of said rocker.

2. Apparatus as described in claim 1, wherein:

said lateral deflection offset spring mounting means comprises an angled mounting surface on said mounting means for said proximal end of said buckling spring, said angled mounting surface deflecting the portion of said spring at a point along said spring intermediate said distal and proximal ends laterally in said first chosen direction.

3. Apparatus as described in claim 2 and further comprising:

said angled mounting surface for said proximal end of said spring means pivotally supports the edge of said spring on the side thereof facing in said first chosen direction.

4. Apparatus as described in claim 3, wherein:

the pivot point of said pivoting rocker type electrical actuating means is colinear with an edge of said buckling compression spring means.

* * * * *